US011274892B2

(12) United States Patent
Franssen

(10) Patent No.: US 11,274,892 B2
(45) **Date of Patent: *Mar. 15, 2022**

(54) SAFETY DEVICE FOR A FIREARM

(71) Applicant: FN HERSTAL S.A., Herstal (BE)

(72) Inventor: Pascal Franssen, Saint-Remy (BE)

(73) Assignee: FN HERSTAL S.A., Herstal (BE)

( * ) Notice: Subject to any disclaimer, the term of this patent is extended or adjusted under 35 U.S.C. 154(b) by 0 days.

This patent is subject to a terminal disclaimer.

(21) Appl. No.: 16/967,108

(22) PCT Filed: Feb. 7, 2019

(86) PCT No.: PCT/EP2019/052994

§ 371 (c)(1),
(2) Date: Aug. 3, 2020

(87) PCT Pub. No.: WO2019/154906

PCT Pub. Date: Aug. 15, 2019

(65) Prior Publication Data

US 2020/0363153 A1 Nov. 19, 2020

(30) Foreign Application Priority Data

Feb. 9, 2018 (EP) ..... 18156024

(51) Int. Cl.
*F41A 17/42* (2006.01)
*F41A 17/58* (2006.01)
*F41A 19/26* (2006.01)

(52) U.S. Cl.
CPC ..... *F41A 17/42* (2013.01); *F41A 17/58* (2013.01); *F41A 19/26* (2013.01)

(58) Field of Classification Search
CPC ..... F41A 17/42; F41A 17/56; F41A 17/58; F41A 19/26; F41A 19/27; F41A 19/32
(Continued)

(56) References Cited

U.S. PATENT DOCUMENTS 4,462,179 A * 7/1984 Rogak ..... F41A 3/04 42/1.07
5,736,667 A * 4/1998 Munostes ..... F41A 11/00 42/16

(Continued)

FOREIGN PATENT DOCUMENTS

EP 2205925 B1 7/2010
EP 2831531 B1 2/2015

(Continued)

OTHER PUBLICATIONS

International Search Report and Written Opinion in PCT/EP2019/052994, dated Mar. 8, 2019.

*Primary Examiner* — Bret Hayes
(74) *Attorney, Agent, or Firm* — Leydig, Voit & Mayer, Ltd.; Gerald T. Gray

(57) ABSTRACT

A safety device for a firearm that makes it possible to prevent a shot from being fired, without blocking the rearming function, the said safety device comprising a retainer that can be moved between a stopping position that blocks the moving parts of the weapon in a rear position, and a released position that allows the said moving parts to move in both directions, the said safety device comprising a safety element that can move between a position that blocks the retainer in the stopping position and a position that releases the retainer, the said safety element bearing against an immobile part of the safety device and the said safety element being able to be moved towards the position that releases the retainer through a rearward movement of the moving parts.

16 Claims, 10 Drawing Sheets

(58) Field of Classification Search
USPC ..... 89/27.12; 42/66, 70.01, 70.04, 70.05, 42/70.06, 70.08
See application file for complete search history.

(56) References Cited

U.S. PATENT DOCUMENTS

| | | | | |
|---|---|---|---|---|
| 5,913,261 | A * | 6/1999 | Guhring | F41A 17/36 89/128 |
| 6,907,813 | B2 * | 6/2005 | Gablowski | F41A 17/32 42/70.04 |
| 8,359,778 | B2 * | 1/2013 | Doll | F41A 17/42 42/69.01 |
| 2007/0266845 | A1 * | 11/2007 | Polston | F41A 19/33 89/139 |
| 2011/0168008 | A1 | 7/2011 | Landies et al. | |
| 2015/0168091 | A1 * | 6/2015 | Doll | F41A 19/26 42/69.01 |
| 2017/0184366 | A1 | 6/2017 | Zajk et al. | |
| 2021/0041198 | A1 * | 2/2021 | Franssen | F41A 17/16 |

FOREIGN PATENT DOCUMENTS

| | | | |
|---|---|---|---|
| WO | WO 2003/054470 | A1 | 7/2003 |
| WO | WO 2016/161059 | A1 | 10/2016 |

* cited by examiner

SAFETY DEVICE FOR A FIREARM

CROSS-REFERENCES TO RELATED APPLICATIONS

This application is a US National Phase application claiming priority to International Application No. PCT/EP2019/052994, filed on Feb. 7, 2019, which claims priority to EP Patent Application No. 18156024.4, filed on Feb. 9, 2018. All of the afore-mentioned patent applications are hereby incorporated by reference in their entireties.

FIELD

The present disclosure relates to a safety mechanism integrated into a firing mechanism for firing a machine gun.

PRIOR ART

A machine gun is traditionally a weapon used for suppressive firing. The purpose of suppressing the firing is to pepper the combat zone with a significant quantity of projectiles. The weapon employed is then described in terms of its "firepower".

In order to perform this suppressive firing, it is preferable to fire from an ammunition belt because this allows a significant quantity of rounds to be fired without the need to take a break to change the magazine.

Because of this significant quantity of rounds fired, the weapon and the barrel heat up very significantly. As a result, there is a significant risk that the powder of a cartridge in the chamber of the barrel waiting to be fired may cook off. Cook-off is therefore an untimely and undesired letting-off of a shot (the shooter has not pressed the trigger of the weapon in order to command the firing). "Closed-bolt" guns all display this safety fault risk. Closed-bolt operation means that the breech is locked to the chamber of the barrel awaiting the release of a shot. By contrast, conventionally, machine guns generally fire "open-bolt", namely without the breech being locked to the chamber of the barrel in readiness for firing. The breech is at the rear of the frame, waiting to be released in order to feed a round into the chamber. Thus, the risk of cook-off in open-bolt operation is zero because the round waiting to be fired is in a cold zone (away from the chamber of the barrel).

Because they are used at high rates of fire, the firing mechanism generally includes only an automatic function. What that means is that the weapon fires only in bursts. It does not fire in a semiautomatic manner, namely fire just one shot each time the trigger is squeezed. Closed-bolt guns often have dual functionality: semiautomatic-fire and automatic-fire.

Historically, the principle of fire control for machine guns has changed very little since the MG42 developed in Germany during the second world war. The firing mechanism is made up of a trigger blade, a stop halting the moving parts in the open position, at the rear of the frame, and a release lever keeping the stop in the lowered position during the forward movement of the moving parts. In order to release the moving parts (the breech and the breech block) so that they can move, it is necessary to squeeze the trigger which pushes on the stop to retract it out of the path of the moving parts. During this movement of the trigger, the front end of the stop is intercepted by the release lever which is not in the path of the moving parts as long as the operator is pressing on the trigger blade. When the operator releases the trigger blade, the release lever returns into the path of the moving parts, keeping the stop in the firing position until the moving parts recoil. When the moving parts recoil, they push the release lever rearward, and this releases the stop. The moving parts are then once again immobilized by the stop in the rearward position, under the pressure of the weapon recoil spring.

The release mechanism makes it possible to a certain extent to limit wear on the stop sear because it ensures that the moving parts come to rest in the most rearward possible position. When the moving parts are rearward, their speeds are low, and this means that the kinetic energy of the moving parts, which will be imparted to the stop when they are halted, will be at its minimum. In addition, this mechanism makes it possible to avoid the risk of the moving parts not being retained by the anti-runaway catch so that the machine gun does not suffer from a lack of recoil. The anti-runaway catch is an immobilizing catch underneath the moving parts allowing these to be immobilized when they do not recoil far enough to catch on the normal catch. In the absence of such a catch, a lack of recoil may prevent the moving parts from catching on the stop when the trigger blade is released, leading to a burst being fired even though the operator is attempting to cease fire. In order to prevent such "runaway", the anti-runaway catch is arranged in such a way as to immobilize the moving parts in terms of their forward movement just after having caught on the rear of the awaiting cartridge. In this way, a lack of recoil that would not catch on the anti-runaway catch cannot load the new cartridge, thus preventing continuing fire.

On the MG 42 and the weapons based on the firing mechanism thereof, safety is achieved by a push-button system transverse to the axis of the barrel of the weapon. In the position that allows automatic fire, the push-button allows the lowering of the stop, which releases the moving parts. When the safety is on, the stop butts against the push-button before the moving parts are able to disengage from the stop sear. This particularly simple and effective mechanism does not allow the weapon to be re-cocked while the safety is on and neither does it allow semiautomatic firing.

The firing mechanisms of open-bolt weapons do not all have the release-lever system. In the absence of a release lever, the trigger blade controls the stop directly. That means that it is possible that the operator might release the stop while the moving parts are moving forward. If that happens, the stop will not necessarily catch on the moving parts with optimal (face-against-face) contact, and will do so with the moving parts potentially moving at high speed (if the stop catch intercepted by the stop is not the catch that corresponds to the moving parts in the rearward position but is in fact the anti-runaway catch), and that means that the wear on the stop sear is increased by comparison with that of a mechanism that does have a release lever. Excessive damage to the stop sear may compromise the safety and reliability of the weapon.

With this system, safety consists of a mobile pin that is transverse to the weapon and that limits the movement of the stop when the weapon is in the "safe" position. That means that the weapon cannot be re-cocked if the safety is on because the stop is unable to retract out of the path of the moving parts as these recoil. Another consequence is that the safety cannot be engaged if the moving parts are forward because the release lever keeps the stop out of the way as long as the moving parts have not been recoiled by hand.

In order to allow an open-bolt weapon to be re-cocked when its safety is on, patent EP 2205925 B1 describes a particular mechanism in which the stop is made up of two parts: a stop lever and a safety lever. A spring between the stop lever and the safety lever forces the latter into a position of rest so that it no longer performs its function of butting against the fire selector when the moving parts are pulled rearward with the safety on. When the moving parts return forward under the influence of the recoil spring, the moving parts cause the safety lever to pivot and they stop on the stop lever. In pivoting, the safety lever moves into a position which allows it to perform a function of limiting the travel of the stop when the safety is on.

One disadvantage with the system proposed in patent EP 2205925 B1 is that, in order to allow the user to engage the safety whatever the condition of the weapon, it is necessary to leave the trigger blade a certain degree of movement, even in the safe position. In order to allow the travel of the trigger blade to be completely immobilized by the safety lever, patent EP 2831531 B1 describes a mechanism that is modified in such a way as to allow the user to engage the safety whatever the position of the stop. In this new mechanism, the trigger blade and the release lever have been disconnected through the introduction of an intermediate component. As a result, the travel of the trigger blade can be canceled by the fire selector when the latter is in the safe position, and that being while the stop is kept in the lowered position by the release lever.

The mechanisms set out in patents EP 2205925 B1 and EP 2831531 B1 have a major shortcoming in terms of the safety of the weapon particularly in adverse condition. The position of rest of the safety lever is obtained by means of a spring and corresponds to a position that allows disengagement of the moving parts. That means that the safety lever is more readily liable to become jammed in a position that allows the moving parts to be released by the stop by debris of a relatively modest size that may slip in between the stop and the safety lever. If that happens, the weapon can be placed in the safe position and exhibit all the signs of a weapon that is safe even though the travel of the stop is not in any way limited. Under such circumstances the weapon presents a major risk to its operator and the entire combat unit because the weapon is handled as if it were free of danger even though there is nothing to prevent the moving parts from being released by the stop. The fact that incorporating the safety lever directly onto the stop entails the use of very small components (safety lever return spring, safety lever, safety lever pin, etc.), each of which may be the cause of a failure means that the probability of this risky situation befalling the weapon is all the greater.

Another disadvantage with the system set out in EP 2205925 B1 and EP 2831531 B1 is the fact that the safety lever bears directly against the safety pin (pivoting lever acting as a two-position fire selector, the positions being: safe and automatic). This design has the disadvantage that the load associated with limiting the movement of the stop is transferred onto a component that is intermediate with respect to the trigger-guard. Aside from the intrinsically poorer control over the position of the stop when the safety is on (the manufacturing spread on each of the components is cumulative, so the more components there are, the less precise the positioning), it should be noted that the contact that limits the movements of the stop (between the safety lever and the safety pin) is on a cam-shaped part. This cam shape is needed in order to allow the stop to move when the selector lever is in the automatic-fire position, and also to allow the stop to lower when the moving parts are returned rearward with the safety on.

In patents EP 2205925 B1 and EP 2831531 B1, the selector moves from the "safe" position to the "auto" position by rotation of the safety pin. This rotational movement is an ergonomic plus-point for the operator, although uncertainty over the angular position (which is not necessarily associated with a manufacturing defect with the weapon but also with uncertain handling on the part of the operator or environmental influences, etc.) of the safety pin will carry with it a significant risk to the safety of anybody in the vicinity of the machine gun. This is because poor angular positioning of the safety pin will result in the possibility of the safety lever skidding against the surface of the cam and thus allow the stop to move, allowing a shot to be let off accidentally.

Finally, another disadvantage with the firing mechanism described in patents EP 2205925 B1 and EP 2831531 B1 is the lack of a semiautomatic-fire function. The absence of the ability to achieve semiautomatic fire compromises the flexibility of a machine gun that is supposed to be versatile. The need for weapon versatility is connected with issues of deployment and particularly the level at which the weapon is to be distributed.

Historically, weapons that operate on the open-bolt principle but do not fire ammunition belts have had both a semiautomatic function and an automatic function. Notable mention may be made of the Bren light machine gun and the Uzi submachine gun. These weapons are hybrids between support weapons and individual weapons and allow their operators to perform a support role for a limited duration in support of other operators using weapons of more limited fire power (a rifle or a pistol). However, a magazine-feed has intrinsic limits that do not allow the user of a light machine gun (or of a submachine gun) to sustain their fire power for a long enough period to be able to provide as much support as can be provided by a machine gun.

Semiautomatic operation of these open-bolt weapons is often achieved by a disconnector between the trigger blade and the stop. The travel of the trigger blade is more limited when the fire selector is in the automatic-fire position, which means that the trigger blade keeps the stop in a lowered position (out of reach of the stop catches on the moving parts). When the fire selector is in the semiautomatic-fire position, the travel of the trigger blade is enough for the disconnector to come into abutment before the trigger blade and to release the stop which intercepts the moving parts after the first shot fired. While this solution has been acceptable for certain weapons for a while, it does have the disadvantage of being theoretically fallible if the operator squeezes the trigger blade hard enough to release the slide but not hard enough for the travel to be executed in full. When that happens, the weapon fires a burst even though the operator was expecting a single shot, and this is a major safety issue.

In order to maintain a trigger blade travel that is the same whether the selector is in the semiautomatic-fire position or in the automatic-fire position, the fire selector of the UZI submachine gun acts not on the travel of the trigger blade but on the disconnector directly. When the selector is in the semiautomatic-fire position, there is a buffer stop on the movement of the disconnector which thus releases the stop. This solution is particularly simple, but does not address the risk of firing a burst when the fire selector is in the semiautomatic-fire position. This issue is nevertheless limited by the drop in effort required on the trigger blade at the moment at which the moving parts disengage.

This principle was readopted in patent US 2011/0168008 A1 to allow a MAG 58 (M240) machine gun a semiautomatic-fire operation. In addition to the safety defect of such a system in semiautomatic-fire mode, the main disadvantage with this mechanism is the absence of the release-lever system that is, however, present in the MAG 58 and M240 machine guns. In the absence of the release-lever mechanism, wearing of the stop sear is enough of a problem to compromise reliability (variation of the effort required on the trigger blade, which will be interpreted as degraded operation) and safety (the moving parts do not catch as securely on the stop sear) of the weapon during its service life.

In order to allow the creation of a more dependable semiautomatic-fire mode, the designers of the BREN light machine gun opted for a mechanism with a very specific disconnector. This disconnector has two contact possibilities to cause the stop to be lowered and a protuberance that is able to enter the path of the moving parts. When the selector is in the automatic-fire position, the disconnector joins the trigger blade to the stop via the bottom of the latter so that the protuberance of the disconnector is not in the path of the moving parts. In that case, the travel of the trigger blade is somewhat long with a fairly small effort (the lever arm of the disconnector on the stop is at its maximum length). When the fire selector is in the semiautomatic-fire position, the disconnector is in the raised position so that the protuberance lies in the path of the moving parts. When the operator presses the trigger, the effort is transmitted to the stop which releases the moving parts. As the moving parts move forward, they press against the disconnector which releases the stop to move upward. This happens as soon as the moving parts are released, which means that the stop is once again in a position to halt the moving parts after the first shot fired. Because the connection between the disconnector and the stop is from the top, the lever arm of the disconnector on the stop is short. This results in a reduction in the travel of the trigger blade with maximum effort to trigger the shot.

OBJECTS

The various aspects of the invention seek to address at least one of the following problems:

- allowing semiautomatic firing with an open-bolt machine gun design, while at the same time maintaining the release-lever function between the movement of the trigger and the engaging of the moving parts by the stop.
- Allowing the fire safety to be engaged whatever the condition of the weapon (and notably the position of the moving parts) and, once the safety is on, allowing the weapon to be re-cocked (allowing the moving parts to be moved rearward by means of the arming handle).
- Preserving the cease-firing mechanism with release lever whether this is in automatic-fire or semiautomatic-fire mode in order to limit wear on the stop sear and maintain the same level of reliability and safety throughout the service life of the product.
- And in addition, all of these operations need to be accomplished by means of a rotary fire selector, namely a fire selector similar to that of a conventional gun.

The objective of these requirements is to allow a machine gun to have control ergonomics comparable with those of a gun without compromising its supporting capabilities.

SUMMARY

The present invention relates to a safety device for a firearm making it possible to prevent a shot from being fired, without blocking the re-cocking function, and which can preferably be engaged whatever the condition of the weapon, said weapon comprising a stop able to be moved between a stopping position immobilizing the moving parts of the weapon in a rearward position and a release position allowing said moving parts to move in both directions, said safety device comprising a safety element able to move between a position of immobilizing the stop in the stopping position and a position of releasing the stop, said safety element bearing against an immobile part of the weapon, and said safety element being able to be moved toward the position of releasing the stop via a rearward movement of the moving parts.

In the present invention, what is meant by the moving parts is all of the parts set in motion by the weapon reload cycle. This is, for example, an assembly comprising a slide in which a bolt moves, the slide being able to be attached to a gas recoil piston. It may also more simply relate to a breech in the case of a non-locked breech.

According to preferred embodiments, the safety device according to the invention comprises a suitable combination of at least one of the following features:

- the lifting of the stop is commanded by a release lever pivoting about a pivot pin provided on a front part of the stop and held by a hooked pawl to a trigger blade or a rocker that can be connected to or disconnected from the trigger blade upon release of the trigger blade or disconnection of the rocker until such point as the moving parts move toward the rear of the weapon;
- the safety element is placed in the path of the stop by an elastic return element;
- the release of the return movement of the safety element under the stop is performed before the raising of the stop in each sear notch of the moving parts;
- the advance of the release of the return movement of the safety element under the stop on the raising of the stop is obtained by longitudinal offset between the rack formed on the sliding surfaces of the moving parts acting on the safety element, and the rack formed by the sear notches of the moving parts;
- the advance on the release of the return movement of the safety element under the stop on the raising of the stop is obtained by a longitudinal offset between the surface of the safety element and the sear notch of the stop (what is meant by a sear notch, all the surfaces underneath the moving parts and against which the stop bears in order to stop the moving parts);
- the advance on the release of the return movement of the safety element under the stop on the raising of the stop is obtained by having the movement of the safety element toward the position of releasing the stop, and the recoil movement of the moving parts being in opposite direction;
- the movement of the safety element toward the position of releasing the stop via the recoil movement of the moving parts is obtained by means of an intermediate lever or an intermediate wheel;
- the safety element pivots about a pivot pin fixed in the weapon;
- the safety element is retracted by the moving parts by collaboration between the sliding surfaces of the moving parts and the sliding surface of safety element;
- the safety element slides in a direction orthogonal to the movement of the stop.

A second aspect of the invention relates to a firing mechanism incorporating the firearm safety device according to the first aspect of the invention.

Advantageously, the firing mechanism of the invention comprises a semiautomatic-fire function which is obtained by a mechanism further comprising a rocker actuating the stop, and a trigger blade connected to the rocker by a disconnector able either to ensure mechanical coupling between the trigger blade and the rocker, or to disconnect said mechanical coupling between the trigger blade and the rocker, said disconnector being arranged in such a way as to pivot the rocker from the firing position to the rest position, so as to prevent the next shot from being let off when the trigger blade is kept in the firing position.

As a preference, the function of selecting the automatic-fire, semiautomatic-fire function and the function of selecting the safety function are performed by the same control for the operator.

Advantageously, the control mechanism consists of a rotary lever actuating a slider able to move in translation and allowing activation or deactivation of the functions associated with semiautomatic fire and safety, so that three positions of the lever correspond to a safety position, to a semiautomatic-fire position, and to an automatic-fire position.

Advantageously, the slider comprises a safety control slot in which there moves a safety control lug fixed to the safety element, the shape of which allows the permanent positioning of the safety element in the position of releasing the stop when the fire selector is in the semiautomatic or automatic position, and allows the movement of the safety element between the position of immobilizing the stop and the position of releasing the stop when the selector is in the safety position.

As a preference, the shape of the slider immobilizes the trigger blade when the safety is on and releases it when the fire selector is in the semiautomatic or automatic position.

Advantageously, the various slots in the slider comprise notches in which the various lugs become lodged when the selector is in a selection position, so as to prevent the selector from being able to find a position of stable equilibrium between two positions, rendering the weapon status poorly defined.

Finally, the invention also relates to an open-bolt firearm comprising a firing mechanism integrating the firearm safety device according to the first aspect of the invention.

BRIEF DESCRIPTION OF THE FIGURES

FIGS. 2*a* to 2*d* depict various cross sections through an example of a mechanism of the invention, with the various components assembled, the moving parts being positioned in the rearward position, and the safety being on.

KEY TO FIGURES

Figure 1:
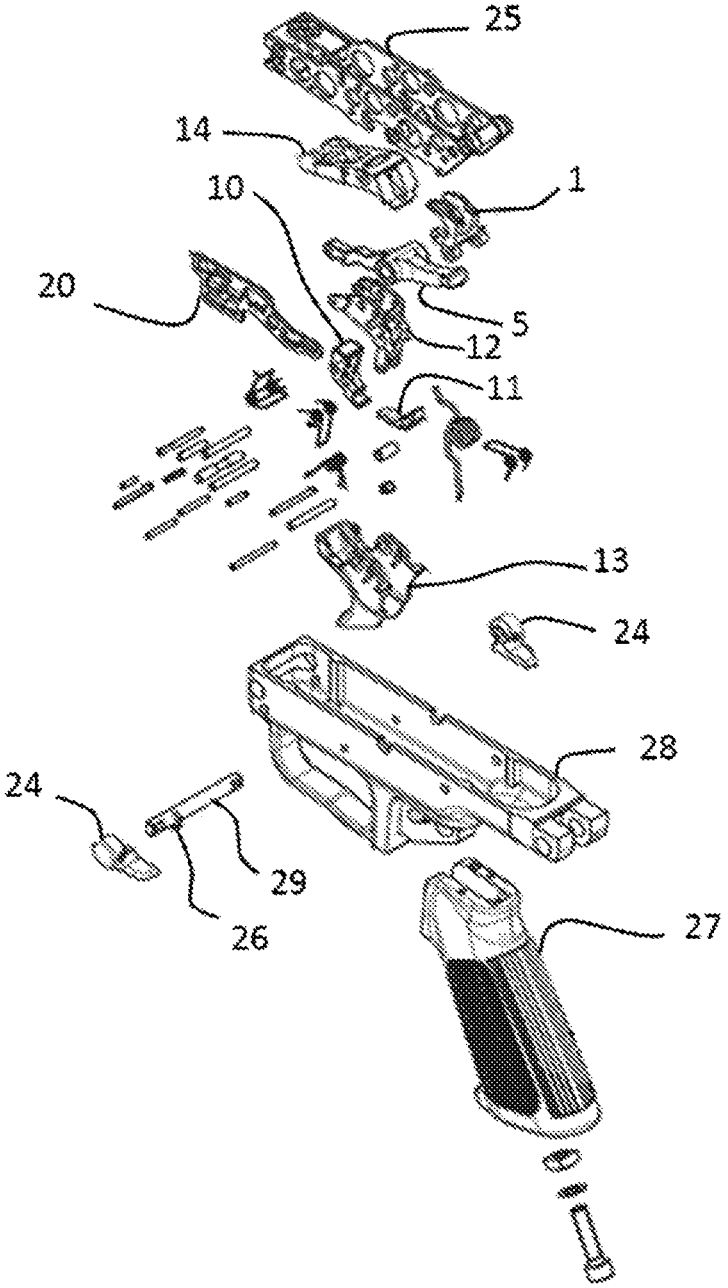
FIG. 1 shows an exploded view of one example of a firing device according to the invention.
Figure 2A:
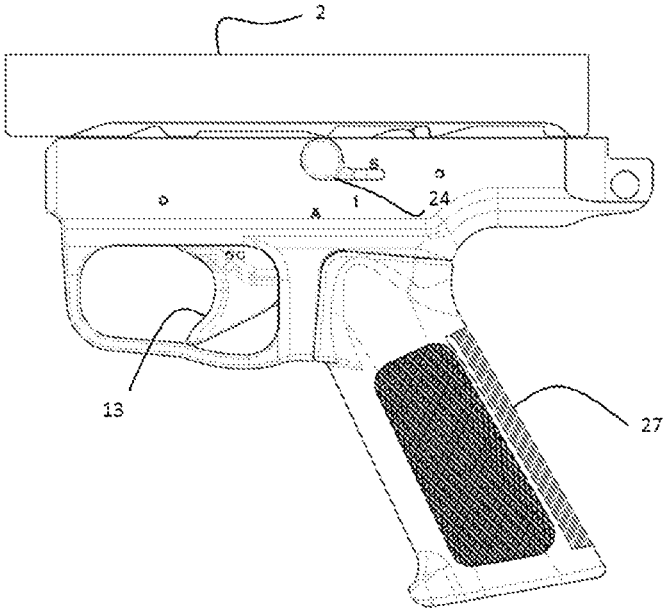
Figure 2B:
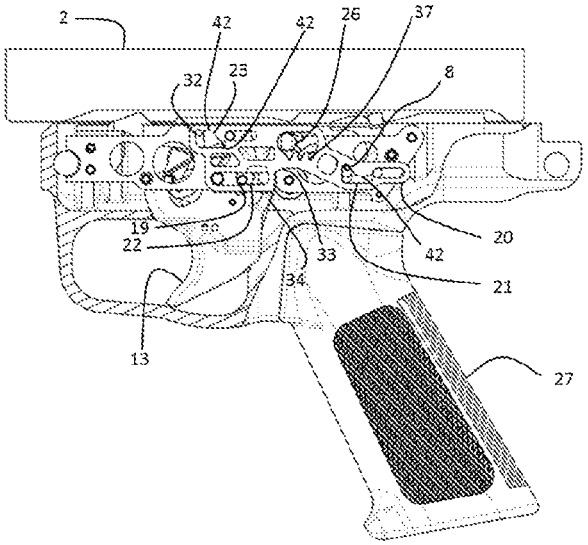
Figure 2C:
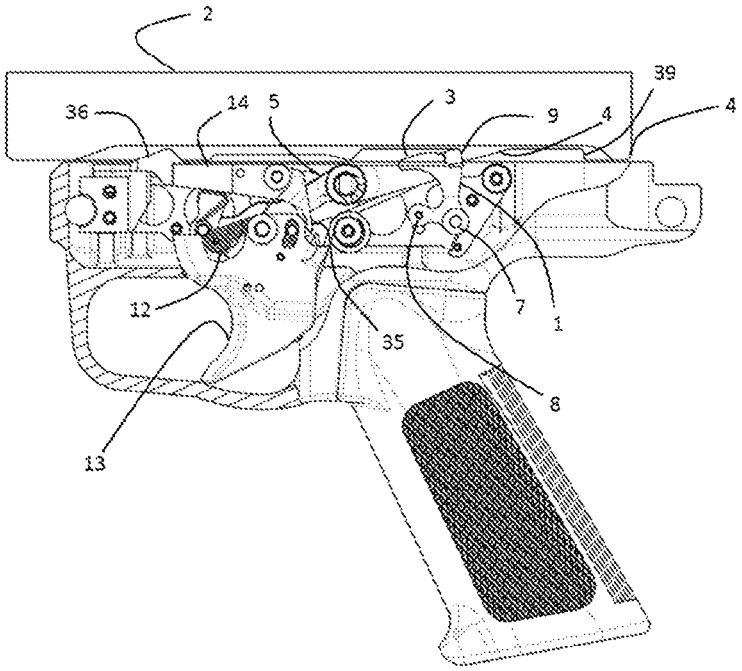
Figure 2D:
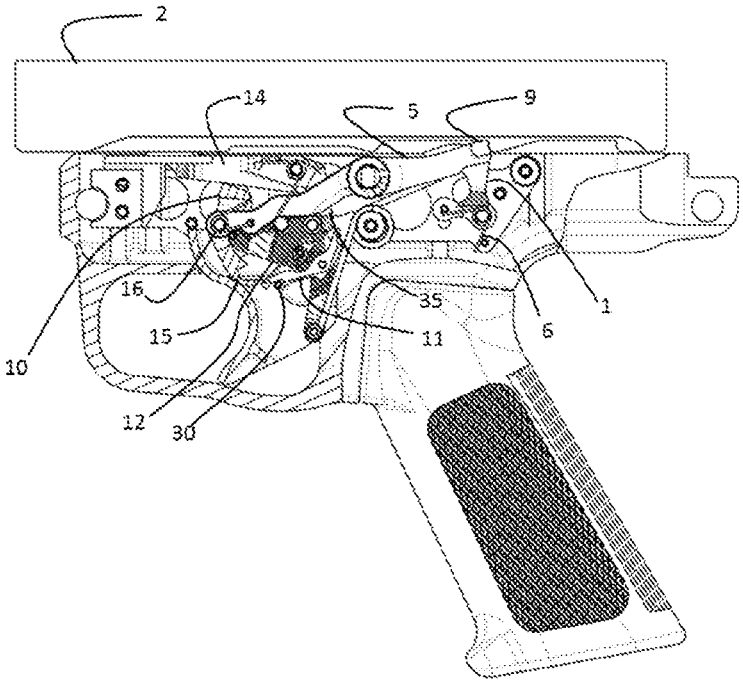
Figure 2E:
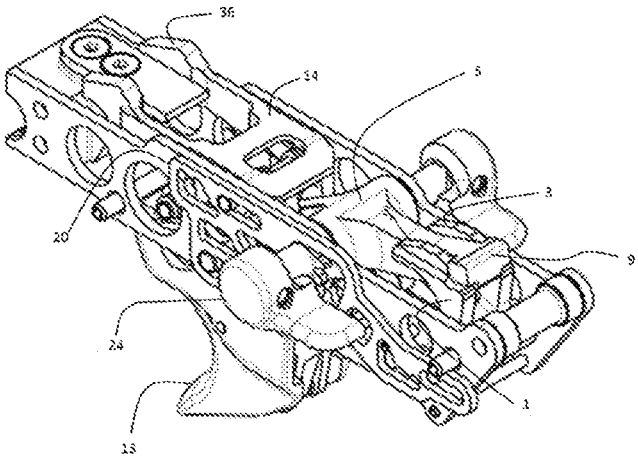
FIG. 2*e* depicts a perspective view of the example of a mechanism of FIGS. 2*a* to 2*d* (in the safe position).

1. Safety element
2. Moving parts
3. Safety-element sliding surface
4. Safety control (and stop-lowering) surfaces under the moving parts
5. Stop
6. Safety-element spring
7. Safety-element pin
8. Safety control lug
9. Stop buffer
10. Stop release lever
11. Disconnector
12. Rocker
13. Trigger blade
14. Disconnector sear
15. Release-lever pawl
16. Release-lever pivot pin
17. Rocker and trigger-blade pivot pin
18. Disconnector pivot pin (attached to rocker)
19. Rocker control lug
20. Slider
21. Safety-element control slot
22. Rocker control slot
23. Disconnector-sear control slot
24. Fire and safety selector lever
25. Fire control assembly housing
26. Meshing slider-control mechanism
27. Grip
28. Fire control frame
29. Pin
30. Disconnector lug
31. Release-lever lug
32. Disconnector-sear control lug
33. Trigger-blade release clearance
34. Trigger-blade immobilizing lug
35. Disconnector-sear disconnection lever
36. Disconnector-sear disconnection cam
37. Slider control rack
38. Disconnector-sear pivot pin
39. Anti-runaway catch
40. Disconnector buffer
41. disconnector-buffer control lug
42. selector notch
50. Second disconnector lug

DETAILED DESCRIPTION

There are two requirements to be taken into consideration when developing a safety mechanism that allows a machine gun to meet safety criteria similar to those of a gun (in terms of the way in which the weapon is handled):

it must be possible to re-cock the weapon when the fire selector is in the safe position.

The fire selector must be able to move into the safe position whatever the condition of the weapon.

Achieving these two functions must not compromise operator safety from the moment the fire selector is in the safe position.

In order to achieve this, according to the invention, when the fire selector is in the safe position, the travel of the stop is limited by a safety element that bears against an immobile part of the weapon. This safety element can be retracted out of the path of the stop to allow the moving part to move from the front toward the rear of the weapon. Cams under the moving parts allow this retraction. A return spring returns the safety element into the path of the stop each time a stop catch of the moving parts passes beyond the stop sear.

The fire selector is connected to the safety element in such a way as to allow it an amplitude of movement when the fire selector is in the safe position, but which forces the safety element to retract out of the path of the stop when the fire selector in a (semiautomatic-fire or automatic-fire) fire position.

On a gun, engagement of the safety is manifested by the blocking of the movement of the trigger blade and the inability of the weapon to fire. The possibility of engaging the safety of a weapon regardless of its condition is an important factor because it reduces the risk to the operator without adding to the complexity of the handling of the weapon.

In order to allow the safety to be engaged and the weapon to be reloaded by the operator while the stop is held in the lowered position by the release lever, the release lever is mounted to rotate not on the trigger blade but directly on the stop or on a mobile rocker positioned between the trigger blade and the release lever.

As a preference, when the release lever is mounted on the stop, the connection between the release lever and the trigger blade is via a hook-shaped pawl that allows the trigger blade to return to its rest position even if the release lever continues to hold the stop in a lowered position. This particular feature makes it possible to overcome the problem of engaging the safety of the weapon regardless of its condition by dispensing with the dividing of the trigger blade into two parts which is the solution proposed in patent EP 2831531 B1 (which is a more expensive solution). Nevertheless, an intermediate rocker may prove beneficial for use in semiautomatic-fire mode. In that case, the release-lever pawl bears not directly on the trigger blade but on the intermediate rocker. Note that in this case, the rocker is of benefit only for semiautomatic-fire: during re-cocking with the safety on, the rocker is not necessarily disconnected from the trigger blade.

In terms of achieving a safety that allows handling similar to that of a gun, the indispensable factor is the presence of a safety element which bears against a rigid part of the weapon, limiting the travel of the stop so as to prevent the moving parts from moving, but which can be retracted by the moving parts when these are in rearward motion.

As a preference, the release lever is mounted on the stop and not on the trigger blade, making it possible to incorporate into the fire selector a buffer that limits the travel of the trigger blade while at the same time allowing the weapon to be made safe whatever the condition of the weapon. Limiting the travel of the trigger blade is a simple and effective indicator to indicate to the operator that the fire selector is in the safe position.

Advantageously, the direction of retraction of the safety element is forward, so that the action of the moving parts as they move rearward on the safety element is interrupted before the stop catch of the moving parts has moved fully beyond the stop sear. Thus, the safety element resumes its function as soon as the stop moves back up after having overcome each stop catch of the moving parts so that there is no risk of an intermediate position in which the moving parts could rest against the stop without the safety being on.

Reversing the direction of retraction of the safety element and the permitted movement of the moving parts can be achieved via oblique contact between the two assemblies (cam shapes) or via an intermediate lever between the two assemblies.

If it is not possible to adhere to the arrangement regarding reversing the permitted direction of movement of the moving parts and the retraction movement of the safety element, it is nevertheless important to advance release of the safety element by the moving parts in comparison with the overcoming of the stop sear by the stop catch of the moving parts. That can be achieved via longitudinal offsetting of the rack that retracts the safety element by comparison with the stop catches of the moving parts, or by longitudinal offsetting of the index that retracts the safety element with respect to the position of the stop sear.

In order to allow the semiautomatic operation to be achieved, the firing mechanism has been modified according to the following principle:

the trigger blade is split into two elements. One of these elements still performs the function of a trigger blade as far as the user is concerned. This element is referred to hereinafter as the trigger blade. The other component performs functions internal to the weapon, namely of pushing on the stop in order to release the movement of the moving parts and acting on the release lever to allow the halting of the moving parts. This component is referred to hereinafter as the rocker.

A disconnection function is added between the trigger blade and the rocker so that when the fire selector is placed in the semiautomatic-fire position, the forward movement of the moving parts leads to disconnection between the trigger blade and the rocker allowing the latter to pivot into the cease-firing position even if the operator is still pressing on the trigger blade.

Alternatively, disconnection can be achieved by a buffer positioned in the path of the disconnector. According to a first alternative, this buffer is positioned in the path of the disconnector only when the fire selector is in the semiautomatic position. According to a second alternative, the buffer is fixed but the travel of the trigger blade is limited in automatic mode in order to prevent contact between the buffer and the disconnector.

In the case of disconnection by the moving parts, the function of disconnection between the rocker and the trigger blade can be achieved by a single component if the travel of the trigger blade differs between automatic-fire mode and semiautomatic-fire mode. In that case, the moving parts act directly on the disconnector when the fire selector is in the semiautomatic position. This method is simple to embody but has the disadvantage of modifying the control effort required of the operator depending on whether he is firing in semiautomatic or in automatic mode.

It is not uncommon to observe a difference in the grouping of the impacts of a weapon (precision error) according to the variation in control effort required of the operator. In effect, the operator will have applied a different aim-off to his weapon if he needs to pull differently on the trigger blade when firing a burst or firing single shots. In addition, a significant variation in the effort or travel needed to release the moving parts may be interpreted by the operator as a weapon malfunction. This potential for confusion between the operation of the weapon and degraded operation has a tendency to sap the confidence that the operator has in his weapon which he believes to be of inferior quality.

For this reason, it is preferable, in order to achieve disconnection, to resort to a two-component mechanism (the two components namely being the disconnector and a disconnector sear). In this type of mechanism, the disconnector always acts between the trigger blade and the rocker, but the disconnection command is communicated by the moving parts to the disconnector via the disconnector sear. In that case, the fire selector acts no longer on the travel of the trigger blade but on the position of the disconnector sear prior to firing. When the fire selector is in the semiautomatic-fire position, the disconnector sear is in a position at rest in the path of the moving parts, whereas when the fire selector is in the automatic-fire position, the disconnector sear is positioned in a position out of the path of the moving parts.

Finally, it should be noted that while there is no need for the fire selector that allows the weapon to be made safe to be the same as the selector allowing the selection to be made between semiautomatic operation and automatic operation, it is preferable for the choice between these various functions to be made via the same control in the form of a three-position rotary lever. The connection between the lever and the various elements involved in achieving the safe and semiautomatic functions may be direct. In that case, it may be complicated to control simultaneously numerous components that may potentially be distant from one another.

Another aspect of the invention therefore relates to a selector slider that converts the position of the lever into a possible position of the components (particularly the safety element and the disconnector sear) via slots the shape of which makes it possible either to immobilize the lugs on the components that are to be controlled, or to leave said lug a certain degree of freedom (for example in the case of the safety). This slider is particularly advantageous in the example described hereinafter, but is more generally advantageous whenever the various elements that are to be controlled are numerous and distant from one another.

It may be advantageous for the link between the fire selector and the selector slider to be a meshing connection of the rack and pinion type. Nevertheless, other alternatives are possible (an eccentric on the selector entering a vertical oblong hole in the selector slider, or a linkage/crank system, etc.).

Finally, in order to make it possible to achieve a combination between a system incorporating the semiautomatic function and the safety system that allows the weapon to be re-cocked in a small amount of space, it may be beneficial for the firing-selector pin also to act as the pivot pin for the stop.

EXAMPLE

FIG. 1 shows an exploded view of one example of a firing device according to the invention.

This device comprises a stop 5 that allows the moving parts 2 to be halted in a rearward position by bearing against notches 51 formed in the bottom of the moving parts 2.

This stop 5 comprises in its front part a pin 16 supporting a release lever 10. This release lever at its base comprises a pawl 15. The assembly made up of stop and release lever is fixed to the devices via a pin 29. This release lever 10 allows the stop 5 to be held out of the path of the moving parts 2 as they move forward, even when the trigger blade 13 is released. Positioning the release lever 10 at the end of the stop allows the weapon to be made safe and reloaded whatever the condition of the weapon.

A rocker 12 is positioned between the trigger blade 13 and the stop 5. This rocker 12 allows the trigger blade 13 to be disconnected from the stop 5 and this, as will be seen later on, will allow semiautomatic-fire to be selected.

The semiautomatic-fire function is essentially implemented through the presence of a disconnector 11 and of a disconnector sear 14, allowing the trigger blade 13 to be disconnected from the rocker 5.

The safety function is essentially implemented by the addition of a safety element 1 and the presence of an immobilizing lug 34 of the trigger blade 13.

The various modes of operation of the weapon, namely safe, single-shot firing or automatic firing, are selected by means of a slider 20 actuated by a meshing slider-control mechanism 26 arranged on a pin 29 and actuated by the fire selector 24.

Safety Operation

FIGS. 2*a* to *d* depict various cross sections of a mechanism of the invention with the various components assembled, the moving parts being arranged in the rearward position and with the safety on.

As can be seen, the moving parts 2 are immobilized in the rearward position by the stop 5, the stop 5 also being maintained in the raised position by the safety element 1 immobilizing the buffer 9 of the stop in the raised position. This safety element 1 is kept in this position by a spring 6. It may be seen in this situation that pressure on the trigger blade 13 will not allow the stop to be moved and the moving parts to be released.

It may also be noted that the safety control slot 21 of the slider 20 allows the safety element to rotate and therefore retract when the moving parts are moved rearward. This retraction is brought about by the sliding of the sliding surface 3 on the corresponding surfaces 4 under the moving parts.

Furthermore, the movement of the rocker 12 is limited by the lug 19 in the slot 22 and the movement of the trigger blade 13 is limited by the immobilizing lug 34 of the trigger blade 13 that bears on the underside of the slider 20.

Semiautomatic Operation

Figure 3:
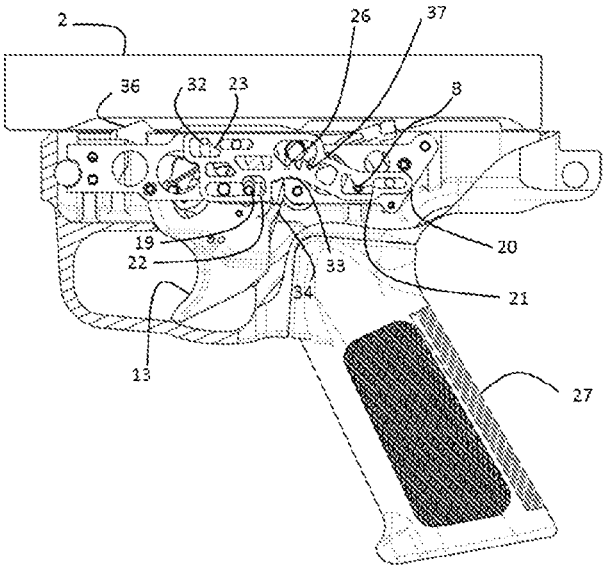
FIG. 3 depicts a cross section through a device according to the invention, with the selector in the semiautomatic position.

FIG. 3 depicts a cross section of a device according to the invention, with the selector in the semiautomatic position. In this position, the slider 20 pushes the safety element 1 out of the path of the buffer 9 by means of the safety control lug 8 sliding in the safety control slot 21, the rocker control slot 22 releases the movement of the rocker control lug 19 and the trigger-blade immobilizing lug 34 is able to move in the trigger-blade release clearance 33. Finally, the disconnector-sear control slot 23 allows the disconnector sear to rise back into the path of the moving parts 2.

Figure 4:
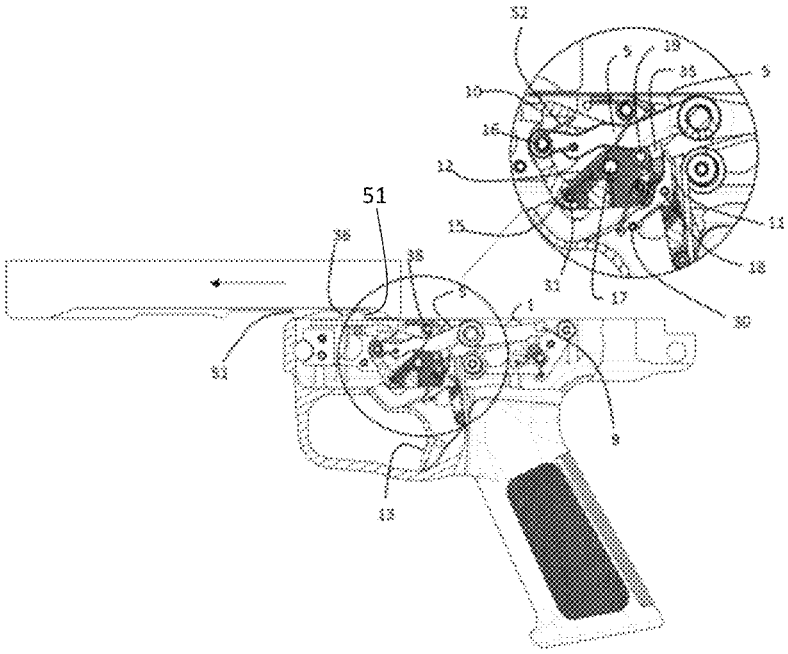
FIG. 4 depicts a cross section through the device of FIG. 3 in which the slider is no longer visible, with the trigger blade pressed, and the moving parts moving forward.

FIG. 4 depicts a cross section of the device of FIG. 3 in which the slider is no longer visible, so as to show the movement of the rocker 12, of the trigger blade 13, of the disconnector 11 and of the disconnector sear 14 in semiautomatic operation. This figure shows the state in the cycle at which the trigger is squeezed, the moving parts advance in a forward direction, and the disconnector sear 14 has not yet uncoupled the rocker 12 from the trigger blade 13.

When the trigger blade 13 is squeezed, it rotates about the pin 17, driving the rocker 12 which pushes via the rocker control lug 19 on the stop 5, leading to the release of the moving parts 2. The coupling between the trigger blade 13 and the rocker 12 is provided by the disconnector 11 rotating about a pin fixed to the rocker 12 and catching on a lug 30 on the trigger blade 13.

As the stop 5 moves it drives upward the release lever 10 of which the pawl 15 catches on the release-lever lug 31 on the rocker 12. This catching will allow the stop 5 to be kept out of the path of the moving parts as they move forward.

A lever 35 of the disconnector sear 14 positions itself between the rocker 12 and the disconnector 11 so that when the moving parts 2 are pressing on the cam 36 of the disconnector sear 14, said lever 35 disengages the disconnector 11 from the lug 30 of the trigger blade 13. This disengagement has the effect of causing the rocker 12 to return to its rest position, placing the release lever 10 in the path of the moving parts 2.

Figure 5:
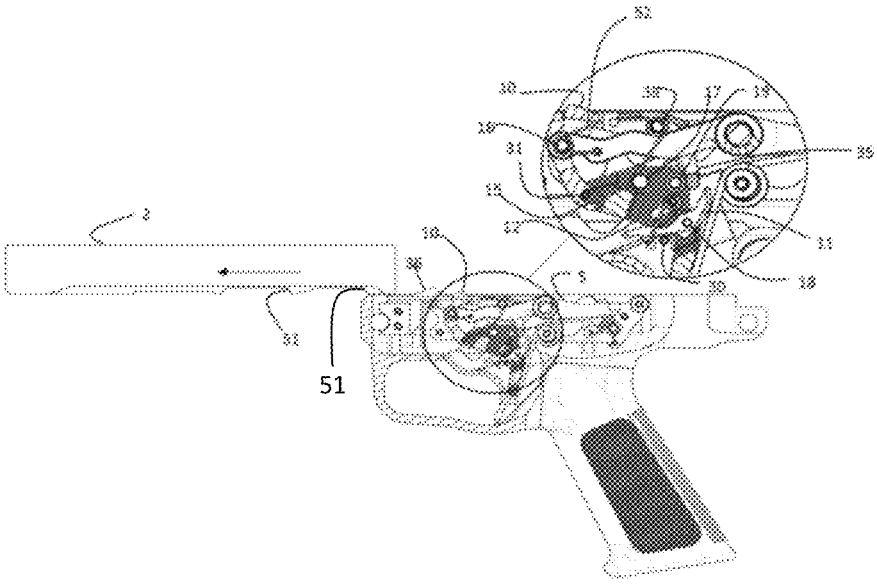
FIG. 5 depicts the same cross section as FIG. 4, after the disconnector has disengaged.

FIG. 5 shows the various components after the rocker 12 has been disconnected from the trigger blade 13 by the disconnector sear 14.

During the rearward return movement of the moving parts 2, these disengage the release lever 10 from the lug 31 of the rocker, thereby allowing the stop 5 to return to its position in which it immobilizes the moving parts forward.

Figure 8:
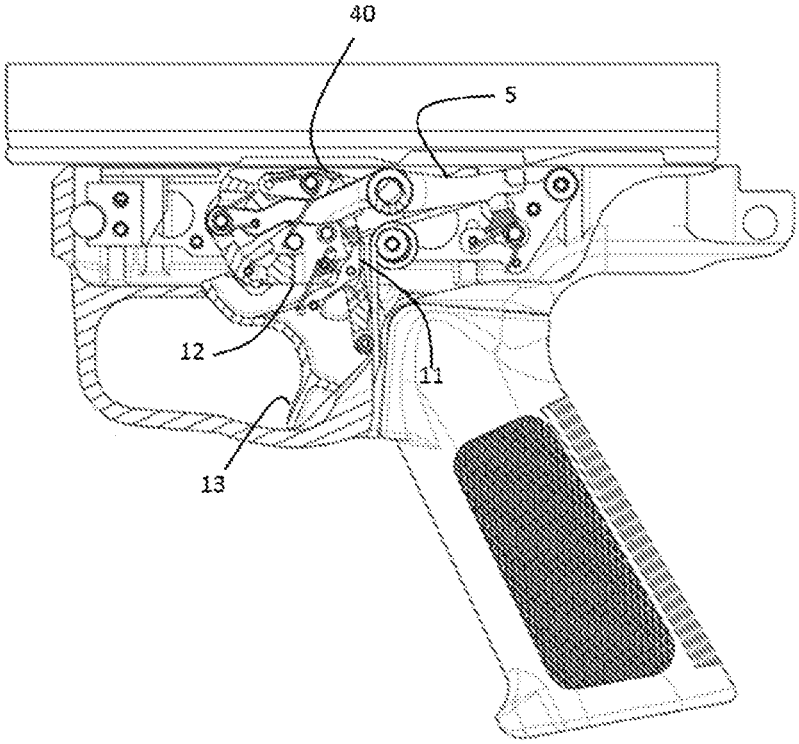
FIG. 8 shows an alternative of the disconnection mechanism between the sear and the rocker with the trigger blade partially engaged.

FIG. 8 shows an alternative semiautomatic-fire selector in which disconnection is brought about by a buffer 40 positioned in the path of the disconnector 11. In this alternative, in semiautomatic mode, when the trigger blade 13 is squeezed, the disconnector 11 comes into contact with the buffer 40 just after the moving parts 2 have been released by the stop buffer 9. This contact causes the disconnector 11 to rotate about its pin 18, thereby uncoupling the disconnector 11 from the trigger blade 13.

Figure 9:
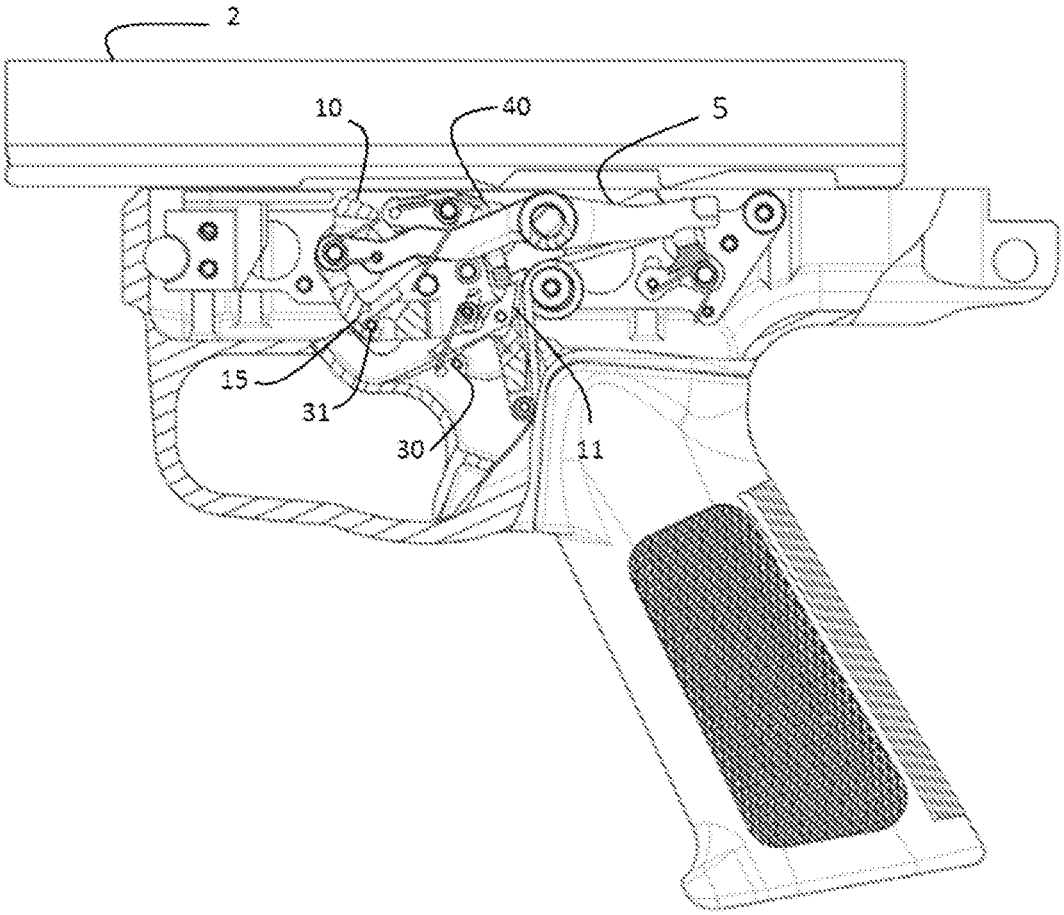
FIG. 9 shows the disconnection mechanism of FIG. 8, with the trigger blade at the end of its travel.

FIG. 9 shows the device of FIG. 8 just after disconnection of the rocker 12, following a continuation of the travel of the trigger blade 13.

Figure 10:
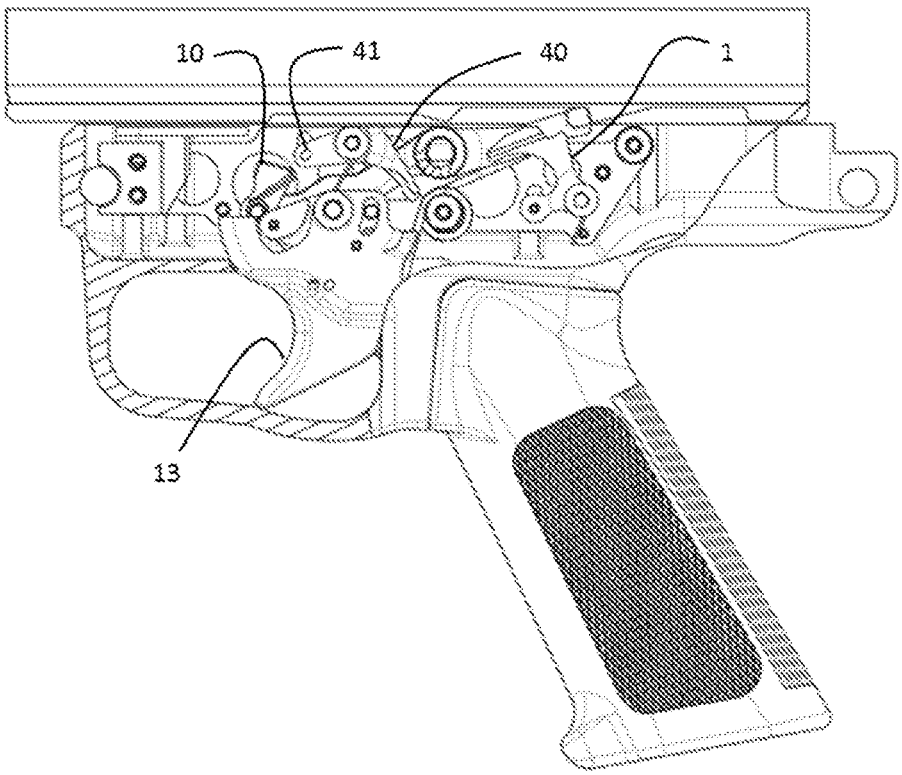
FIG. 10 shows the mechanism of FIG. 8, in automatic mode.

In FIG. 10, the buffer 10 has been retracted out of the path of the disconnector for automatic firing. Such a position of the buffer 40 may advantageously be obtained by a special geometry of a slot in a fire control slider, that moves the disconnection-buffer control lug 41.

In any case, in semiautomatic mode, the disconnector returns to its position of coupling between the trigger blade 13 and the rocker 12 when the trigger blade is released by the operator.

Automatic Operation

Figure 6:
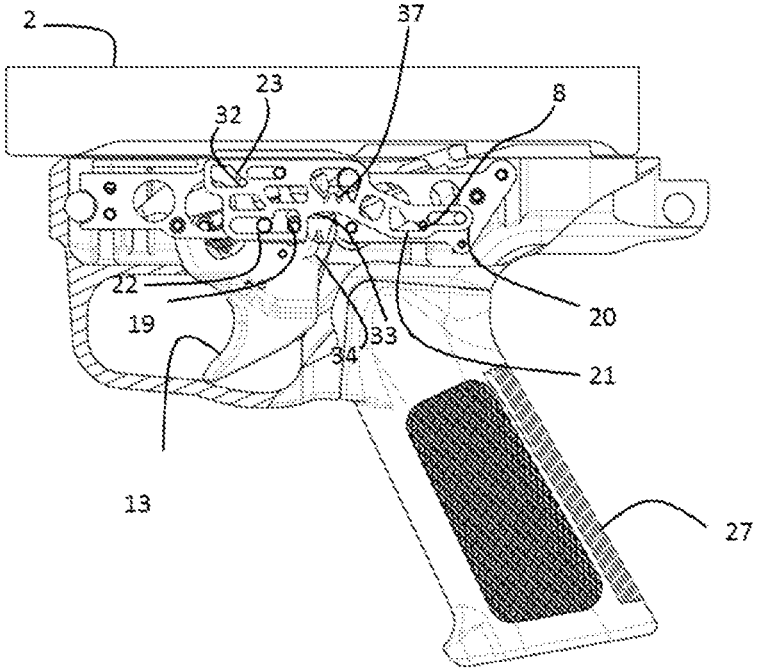
FIG. 6 shows a cross section of the device of FIG. 2, with the slider visible, the selector in the automatic position and weapon at rest.

FIG. 6 shows a cross section of the device of FIG. 2, with the slider visible and the selector in the automatic position. In this position, it may be seen that the disconnector-sear control slot 23, via the lug 32, moves the disconnector sear 14 out of the path of the moving parts 2, thus preventing disconnection between the trigger blade 13 and the rocker 12, allowing automatic firing.

Figure 7:
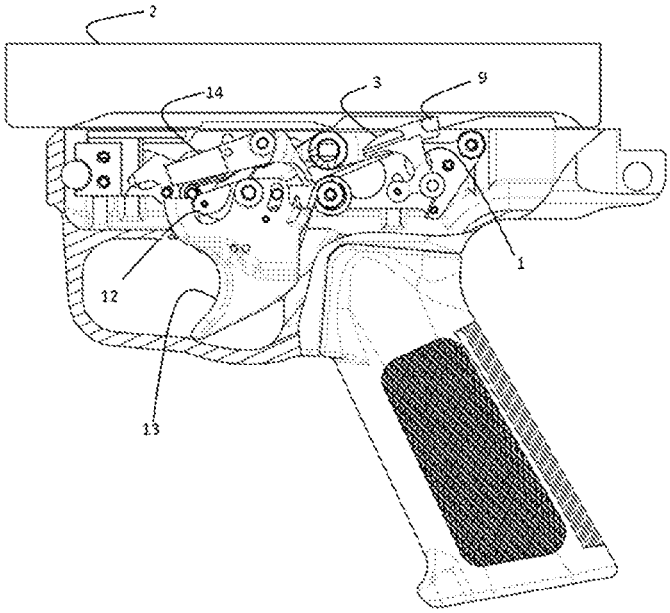
FIGS. 7 and 7*a* show a cross section of the device of FIG. 6, providing a better view of how the various components interact with one another.
Figure 7A:
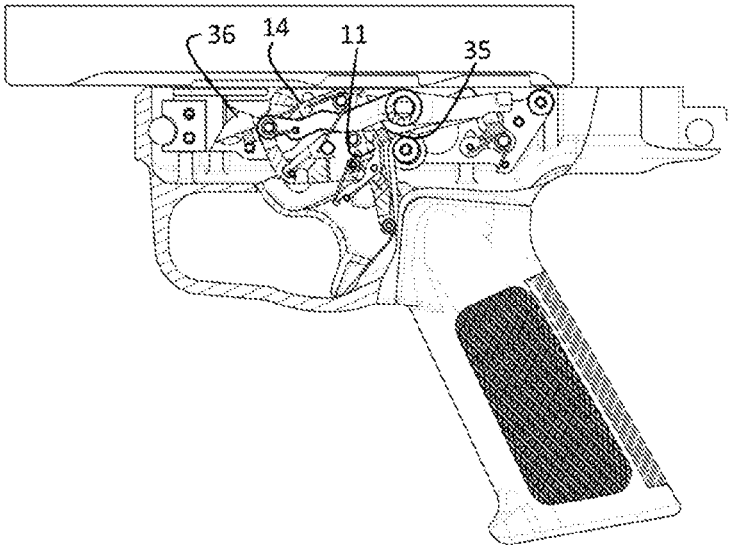

FIGS. 7 and 7*a* show two cross sections of the device of FIG. 6, providing a better view of how the various components interact with one another. In FIG. 7, the trigger blade is at rest, whereas in FIG. 7*a*, the trigger has been squeezed. It will be noted in particular that, when the trigger blade is in the firing position, the disconnector sear lever 14 comes in behind the disconnector lever 11 and keeps the disconnector in the coupled position. This feature may prove beneficial when firing in bursts, which gives rise to a great deal of vibration that can lead to unwanted uncoupling between the rocker 12 and the trigger blade 13.

When the trigger blade 13 is squeezed, the lug 19 causes the stop 5 to pivot and this causes an upward movement of the release lever 10 of which the hook-like pawl 15 catches on the lug 31. When the trigger blade is released, the stop 5 is held in position out of the path of the moving parts by the release lever 10, until the rearward movement of the moving parts 2 which, in passing, disengage the release lever 10 from the rocker 12.

Figure 11:
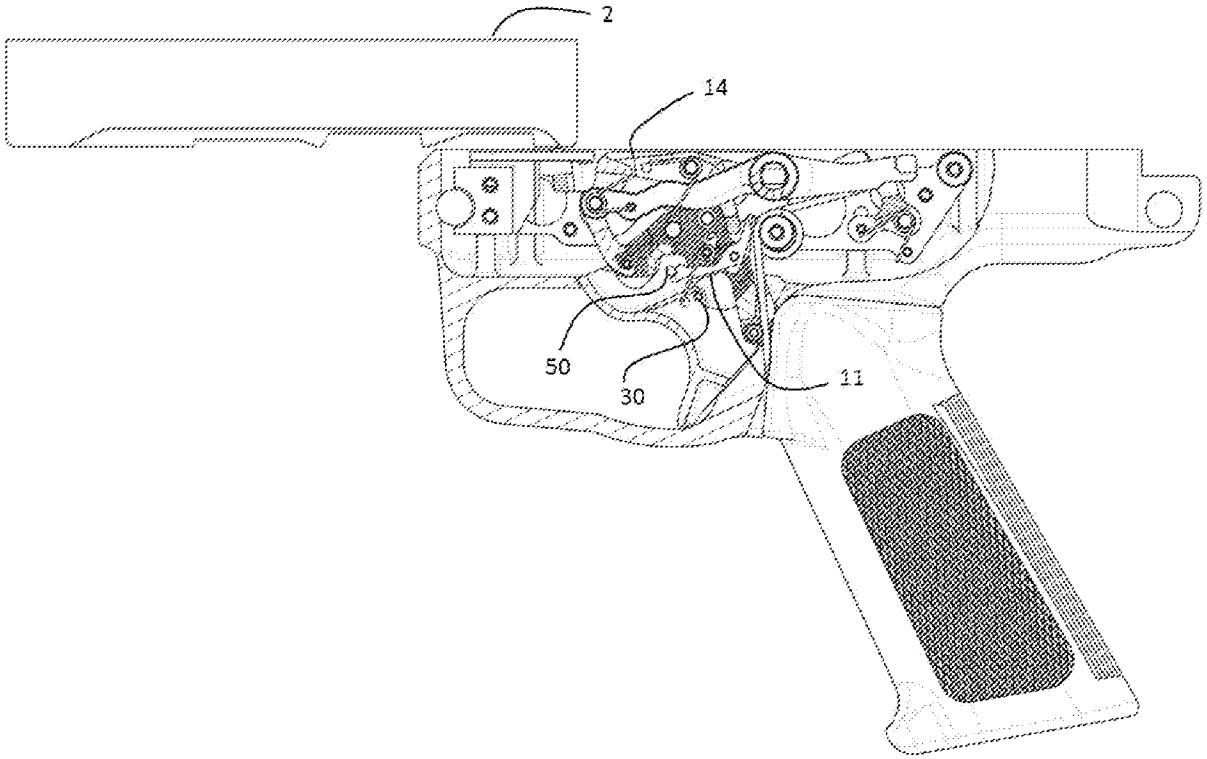
FIG. 11 shows an alternative of automatic operation.

FIG. 11 shows an alternative form of automatic operation in which a second disconnector lug 50 is arranged on the rocker. This additional lug 50 is arranged in such a way that, when the disconnector 11 bears on it, it is no longer in the path of the disconnection lever of the disconnector sear 35. In that case, as shown in FIG. 11, when the automatic mode is selected, the disconnector sear is no longer able to disconnect the coupling between the trigger blade 13 and the rocker 12. Note that this alternative can also be applied in exactly the same way to the alternative in which disconnection is provided by a buffer 40 positioned in the path of the disconnector 11. Note that in this last case, the buffer 40 may be a fixed element, because it no longer needs to be moved for the automatic mode.

Note that as an alternative, the disconnector pin could easily be positioned on the trigger blade, and the disconnector lug or lugs on the rocker.

Exemplary embodiments are described herein. Variations of those exemplary embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A safety device for a firearm, the device configured to prevent a shot from being fired, without blocking a recocking function, said safety device comprising:

a stop configured to be moved between a stopping position immobilizing moving parts of a firearm in a rearward position and a release position allowing said moving parts to move to a forward position and the rearward position, and a safety element configured to move between a position of immobilizing the stop in the stopping position and a position of releasing the stop, said safety element coupled to an immobile housing of the firearm, and said safety element configured to be moved toward the position of releasing the stop via a rearward movement of the moving parts.

2. The safety device for a firearm as claimed in claim 1, wherein a lifting of the stop is commanded by a release lever pivoting about a pivot pin provided on the stop and held by a hooked pawl to a trigger blade, or by a rocker configured to be connected to or disconnected from the trigger blade upon release of the trigger blade, or by disconnection of the rocker until such point as the moving parts moved toward a rear of the firearm.

3. The safety device for a firearm as claimed in claim 1, wherein the safety element is placed in a path of the stop by a spring.

4. The safety device for a firearm as claimed in claim 3, wherein the release of the return movement of the safety element is performed before a raising of the stop in each sear notch of the moving parts.

5. The safety device for a firearm as claimed in claim 4, wherein an advance of the release of the return movement of the safety element on the raising of the stop is obtained by a longitudinal offset between a rack formed by sliding surfaces of the moving parts acting on the safety element, and a rack formed by the sear notches of the moving parts.

6. The safety device for a firearm as claimed in claim 4, wherein an advance on the release of the return movement of the safety element on the raising of the stop is obtained by a longitudinal offset between a surface of the safety element and a sear notch of the stop.

7. The safety device for a firearm as claimed in claim 4, wherein an advance on the release of the return movement of the safety element on the raising of the stop is obtained by having the movement of the safety element toward the position of releasing the stop, and a recoil movement of the moving parts being in opposite directions.

8. The safety device for a firearm as claimed in claim 1, wherein the safety element pivots about a pivot pin fixed in the firearm.

9. The safety device for a firearm as claimed in claim 8, wherein the safety element is retracted by the moving parts by collaboration between sliding surfaces of the moving parts and a sliding surface of the safety element.

10. The safety device for a firearm as claimed in claim 1, wherein the safety element slides in a direction orthogonal to the movement of the stop.

11. A firing mechanism incorporating the safety device as claimed in claim 1.

12. The firing mechanism as claimed in claim 11, wherein a semiautomatic-fire function is obtained by a mechanism further comprising a rocker actuating the stop, a release lever holding the stop in the release position at a start and an end of firing, and a trigger blade connected to the rocker by a disconnector configured either to ensure mechanical coupling between the trigger blade and the rocker, or to disconnect said mechanical coupling between the trigger blade and the rocker, said disconnector being arranged to pivot the rocker from a firing position to a rest position, so as to prevent a next shot from being fired when the trigger blade is kept in the firing position.

13. The firing mechanism as claimed in claim 12, wherein functions of selecting automatic-fire, the semiautomatic-fire function and a function of selecting the safety function are provided by a control mechanism.

14. The firing mechanism as claimed in claim 13, wherein the control mechanism includes a rotary lever actuating a slider configured to move in translation and allow activation or deactivation of the functions associated with semiautomatic fire and safety, wherein three positions of the rotary lever correspond to a safety position, to a semiautomatic-fire position, and to an automatic-fire position.

15. The firing mechanism as claimed in claim 14, wherein the slider comprises a safety control slot in which there moves a safety control lug fixed to the safety element, wherein a shape of the safety control slot allows a permanent positioning of the safety element in the position of releasing the stop when the rotary lever is in the semiautomatic-fire position or the automatic-fire position, and allows the movement of the safety element between the position of immobilizing the stop and the position of releasing the stop when the rotary lever is in the safety position.

16. The firing mechanism as claimed in claim 15, wherein a shape of the slider immobilizes the trigger blade when the safety is on and releases the trigger blade when the rotary lever is in the semiautomatic-fire position or the automatic-fire position.

* * * * *